US006550202B2

(12) United States Patent
Sandoz et al.

(10) Patent No.: US 6,550,202 B2
(45) Date of Patent: Apr. 22, 2003

(54) BUILDING SLAB, ASSEMBLY OF SAME AND USE FOR PRODUCING STRUCTURES CAPABLE OF SUPPORTING HEAVY LOADS

(75) Inventors: Jean-Luc Sandoz, Morges (CH); Jean-Bernard Oth, Colfontaine (BE)

(73) Assignee: C.B.T. Concept Bois Technologie SA, Saint Sulpice (CH)

( * ) Notice: Subject to any disclaimer, the term of this patent is extended or adjusted under 35 U.S.C. 154(b) by 0 days.

(21) Appl. No.: 09/918,270

(22) Filed: Jul. 30, 2001

(65) Prior Publication Data

US 2001/0052211 A1 Dec. 20, 2001

Related U.S. Application Data

(63) Continuation of application No. PCT/FR00/00215, filed on Jan. 31, 2000.

(30) Foreign Application Priority Data

Feb. 3, 1999 (FR) ..... 99 01416

(51) Int. Cl.[7] ..... E04F 13/04

(52) U.S. Cl. ..... 52/352; 52/378; 52/506.01

(58) Field of Search ..... 52/344, 352, 378, 52/407.3, 475.1, 506.01, 745.05, 745.09, 414

(56) References Cited

U.S. PATENT DOCUMENTS 3,846,952 A * 11/1974 De Winter ..... 52/743
4,841,703 A 6/1989 Grimaud ..... 52/334

FOREIGN PATENT DOCUMENTS

| | | |
|---|---|---|
| CH | 258 793 | 12/1948 |
| DE | 610 710 | 3/1935 |
| DE | 195 37 298 | 4/1997 |
| DE | 19537298 | * 4/1997 |
| FR | 2 774 112 | 7/1999 |

* cited by examiner

*Primary Examiner*—Carl D. Friedman
*Assistant Examiner*—Naoko Slack
(74) *Attorney, Agent, or Firm*—Heslin Rothenberg Farley & Mesiti P.C.

(57) ABSTRACT

A building slab is disclosed which is mountable on a support structure and capable of supporting a fixed or mobile load. The slab includes a base structure having a plurality of parallel planks, rectangular in cross-section, and assembled together with nails or screws. The planks have their longitudinal axis parallel to a plane of the slab, and are alternately offset with respect to one another and perpendicularly to the plane of the slab. The base structure is covered, at least over the entire surface to receive the load, with a continuous panel which extends over its entire width and is fixed at least against a top surface of the planks so that the load exerted on the panel is distributed over several lateral planks adjacent to those against which the load is directly exerted. The distribution of the load is along an axis perpendicular to the planks and parallel to the direction in which the planks are nailed or screwed together.

10 Claims, 8 Drawing Sheets

BUILDING SLAB, ASSEMBLY OF SAME AND USE FOR PRODUCING STRUCTURES CAPABLE OF SUPPORTING HEAVY LOADS

CROSS REFERENCE TO RELATED APPLICATIONS

This application is a continuation of copending PCT application PCT/FR00/00215, filed Jan. 31, 2000, designating the United States and claiming priority from French application FR 99.01416, filed Feb. 3, 1999. The priorities of both applications are claimed herein, and the entire disclosures of both applications are incorporated herein by reference.

TECHNICAL FIELD

The invention relates to the field of construction, taken in its broadest sense, and more specifically to the field of the building of various constructions, significant part of which is made of wood.

It relates more particularly to the production of large-sized structural elements such as slabs, suspended platforms or platforms mounted on wooden piles, capable of withstanding heavy loads which may be stationary (buildings for example), or moving, for example when the structure acts as a roadway for a civil engineering works vehicle or a truck.

While the present invention is particularly well suited to producing horizontal structures, it could equally well be used for producing vertical walls.

Furthermore, according to one form of embodiment, the invention is particularly well suited to producing constructions which, if necessary, can be dismantled, particularly in the context of temporary structures.

PRIOR ART

It has long been proposed for platforms mounted on wooden piles to be produced.

Referring to the appended FIG. 1, in order to produce such structures, metal section pieces (1) are placed on posts (2), themselves anchored in the ground.

Mounted at regular intervals along these metal section pieces (1) are wooden beams (3) on which bearing panels (4), generally made of wood or wood derivatives, are placed.

In such a structure, the load per unit area taken by each beam (3) corresponds to the load spread over the bearing panel (4) over a width equal to a spacing (e) or distance between beams.

Hence, in order to ensure sufficient load-bearing capability, it is necessary to choose beams (3) the dimensions of which are large enough to withstand the load which may either be stationary or possibly be moving.

By way of example, for a conventional beam with a span (L) of 4 meters, at a 1-meter spacing, loaded with 350 kg per square meter, to which is added the weight equivalent to the load transmitted by the wheel of a truck, or some other point load, namely 7500 kg placed at the middle of the span, it is necessary to use solid beams having a minimum section of 200 by 500 mm. Such a beam is therefore necessarily made of a glued-laminated structure which can therefore not be dismantled.

A first problem that the invention sets out to solve is that of producing structures which, if necessary, can easily be dismantled, for example in the context of temporary structures, so as to take account of ecological constraints demanding that the materials used in such a context be re-used.

Furthermore, one of the objectives of the invention is to make it possible to produce structures which may or may not be dismantled, at a lower cost than producing beams using the glued-laminated technique.

In consequence, one of the objectives of the invention is therefore to produce such structures using standard components, such as planks 200 mm wide (h), it being possible for the planks to be of various lengths and making it possible to produce structures, of a wide span (from 6 to 12 meters), able to withstand heavy loads, of long length, and to do so using elemental planks which may have a length of between just 2.5 and 5 meters, or for conventional industrial lengths of 2 and 4 or 5 meters.

In the field of building, in order to produce houses, for example, it has been proposed, as is apparent from DE-19537298, for wooden structures consisting of parallel planks to be produced so as, for example, to produce roofs or floors capable of taking very well distributed loads.

According to the teachings of that document, the parallel planks that make up the wooden structure are joined together by nailing, have their longitudinal axis parallel to the plane passing through the edges exterior to the said planks, these being offset alternately from one another perpendicularly to this plane.

While such a solution can be used to take well-distributed loads, it is not, on the other hand, suitable for withstanding high loads exerting stresses in localized regions.

Furthermore, it is totally precluded for such offset-plank structures to be used to produce constructions capable of withstanding moving loads, for example constructions acting as roadways, particularly for civil engineering works vehicles or delivery vehicles used for building buildings intended to be erected on a slab or platform made from wood.

SUMMARY OF THE INVENTION

Now, there has been found, and this is what forms the subject of the present application, a novel type of building slab intended to be mounted on a bearing structure and capable of withstanding a heavy, fixed or moving, load, comprising, in a way comparable of the teachings of the aforementioned DE 19537298, a base structure consisting of a number of parallel planks of rectangular cross section which are joined together by nailing or screwing.

In such a structure, the planks of rectangular cross section have their longitudinal axis parallel to the plane of the slab and are offset alternately from one another perpendicularly to the plane of the said slab.

The slab according to the invention is characterized in that the said base structure is covered, over at least the entire surface intended to take the load, with a continuous panel extending across its entire width, and which allows the loads exerted on the said panel to be spread across several lateral planks adjacent to those against which the load is directly exerted, this spreading being along an axis perpendicular to the said planks and therefore parallel to the direction in which the planks are screwed or nailed together.

According to one form of embodiment, a second panel may be arranged under the planks to further strengthen the slab.

In other words, the building slab according to the invention behaves like the combination of a beam consisting of the collection of planks, and of at least one upper panel to which the loads can be applied directly.

More specifically, the connection of planks nailed and/or screwed together makes it possible to obtain a beam of a width equal to its span or, in other words, a beam which extends across the entire width of the slab it supports.

The offset between two consecutive planks of this structure makes it possible to multiply the bending strength by a factor of 1.5 to 2 by comparison with a beam of a height equal to the width (h) of just one of the constituent planks and to make it far less deformable by reducing the slenderness ratio, which characteristic is the result of the ratio of the length of the span to the thickness of the slab.

In other words, the configuration given to the planks structure is particularly advantageous in terms of bending strength and in terms of deformability.

From another point of view, such a configuration makes it possible to obtain mechanical strength with a saving of material.

Furthermore, by virtue of the fact that the various planks are joined together by nailing or, preferably, by screwing, it may be possible for such a structure to be completely dismantled when no longer in use, this thus making it possible for the planks to be reused or recycled after dismantling.

In such a case, the load-spreading panel associated with the base structure will preferably consist of a wooden panel preferably of crossed microply type, has a strong axis in the direction of the fibres and a weak axis in the direction of two or three crossed plies, the said panel being screwed to the base structure with its strong axis perpendicular to the axis of the planks of the said structure.

When there is no desire to make disassembly easier, then according to an alternative form of the invention, the load-spreading panel may consist of a layer or sheet of concrete which may be poured into the base structure consisting of offset planks.

In such a case, metal rods may be incorporated into the layer of concrete in order to increase the shear strength and the quality of the composite wood-concrete section.

By virtue of the load-spreading panel that the slab according to the invention has, the load can be spread over several lateral consecutive planks adjacent to those against which the load is directly exerted, this spreading being along an axis perpendicular to the planks and therefore parallel to the direction in which the planks are screwed or nailed together.

Advantageously, the planks of the base structure are offset alternately by a distance of between half and two-thirds of their width (h), which, in terms of bending strength, means a 150 to 200% increase.

In practice, a sealing layer such as asphalt may possibly be poured onto the surface of the load-spreading panel.

When the load-spreading panel consists of poured concrete, this concrete enters the spaces formed between two offset planks at the same level, this improving the bond between the concrete and the wood, to give compound inertia with the concrete in compression and the wood in tension.

In other alternative forms of embodiment, it may be envisaged for the space between two offset planks at the same level to be filled with an acoustic or even alternatively a thermal insulant.

It is also possible to use the space between the planks for rooting trunking, ducting or else electric wires.

Furthermore, in order to meet transport constraints, it is possible to produce large-sized platforms using elemental slabs according to the invention, joined together and set in place on a bearing structure.

In this case, each slab has a cut-out capable of allowing it to be arranged with the beams of the bearing structure.

When several slabs are thus joined together, a seal is preferably produced at the joint between panels.

Furthermore, in order to improve the durability of the panel, chemical treatments may be applied to the surface.

BRIEF DESCRIPTION OF THE FIGURES

The way in which the invention can be achieved, and its ensuing advantages, will become clearly apparent from the description of the embodiments which follow, with the support of the appended figures, in which.

EMBODIMENT OF THE INVENTION

As already stated, the invention relates to a building slab intended in particular to be used for producing platforms mounted on wooden piles, but also for producing floors, walls or facades of buildings.

Figure 1:
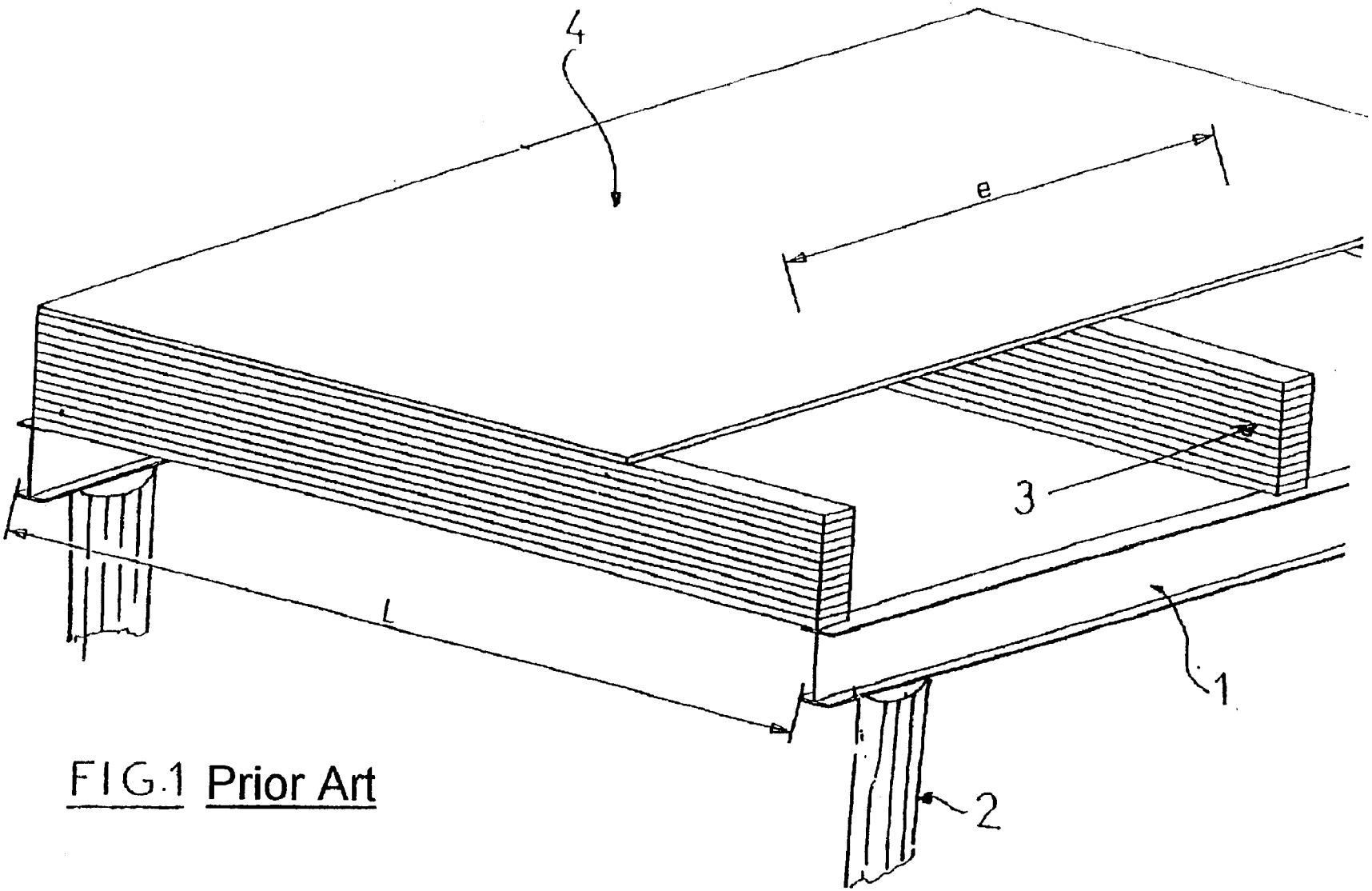
FIG.1 Prior Art
FIG. 1 is a rough perspective view of a platform structure produced according to the prior art.
Figure 2:
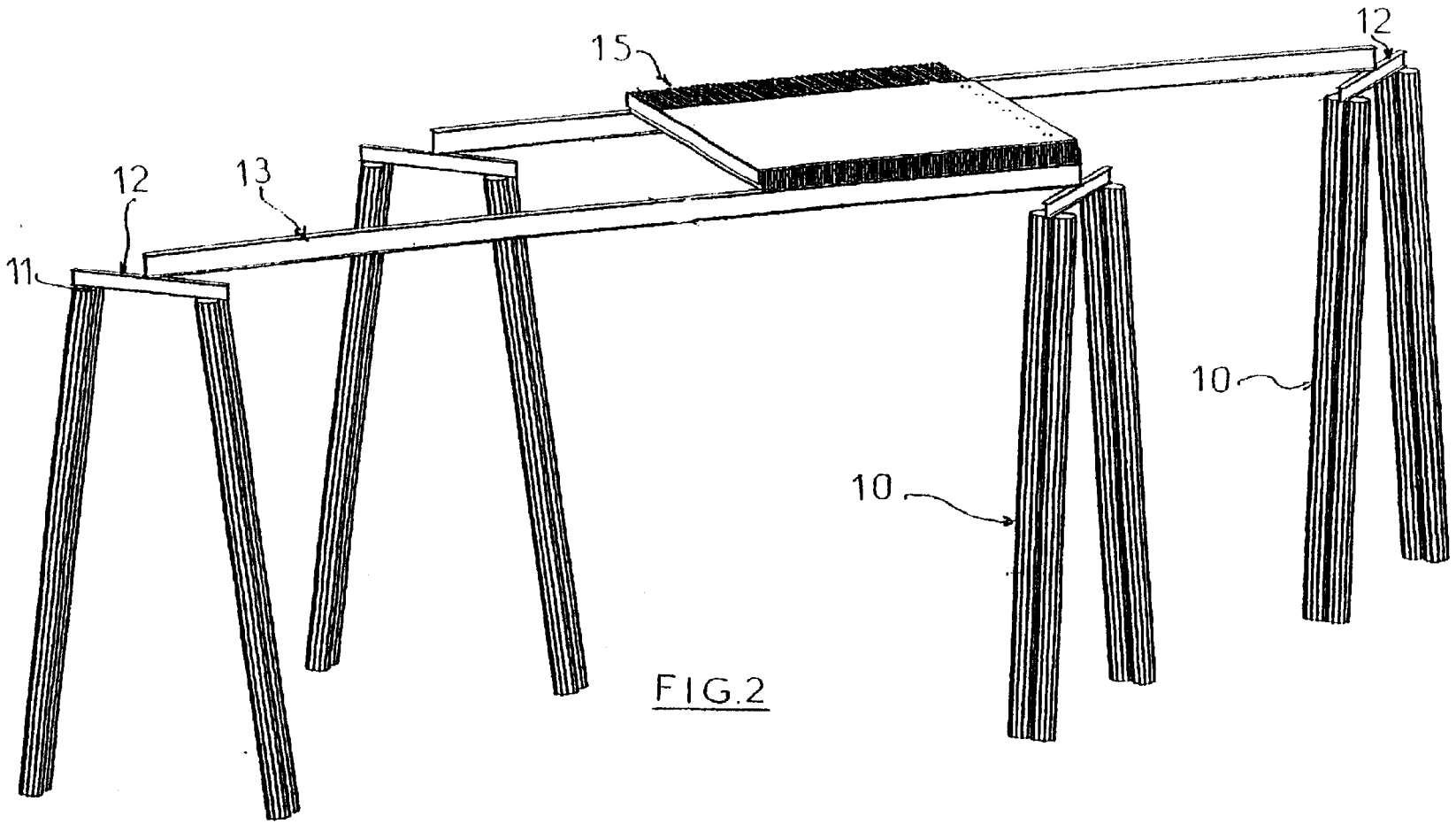
FIG. 2 is a rough perspective overview of a platform structure produced according to the invention.

Thus, in order to produce a structure on wooden piles, use is made, as illustrated schematically in FIG. 2, of a collection of piles (10) firmly anchored in the ground or, in the case of offshore platforms, anchored in the sea or lake bed.

At their upper end (11) these various piles (10) exhibit support elements (12) intended to take beams (13) which, in the example illustrated, consist of metal section pieces.

The collection of the piles (10) and the various beams (12, 13) constitute what will hereafter be known as a "bearing structure".

The invention relates to the various slabs (15) which are set in place on the metal beams (or wooden beams) (13) and which are intended to withstand the heavy load which will be applied.

This load may be stationary, in the case of buildings or may alternatively be moving, if this platform is used as a roadway, particularly for civil engineering works vehicles and delivery vehicles used to build these buildings.

Figure 3:
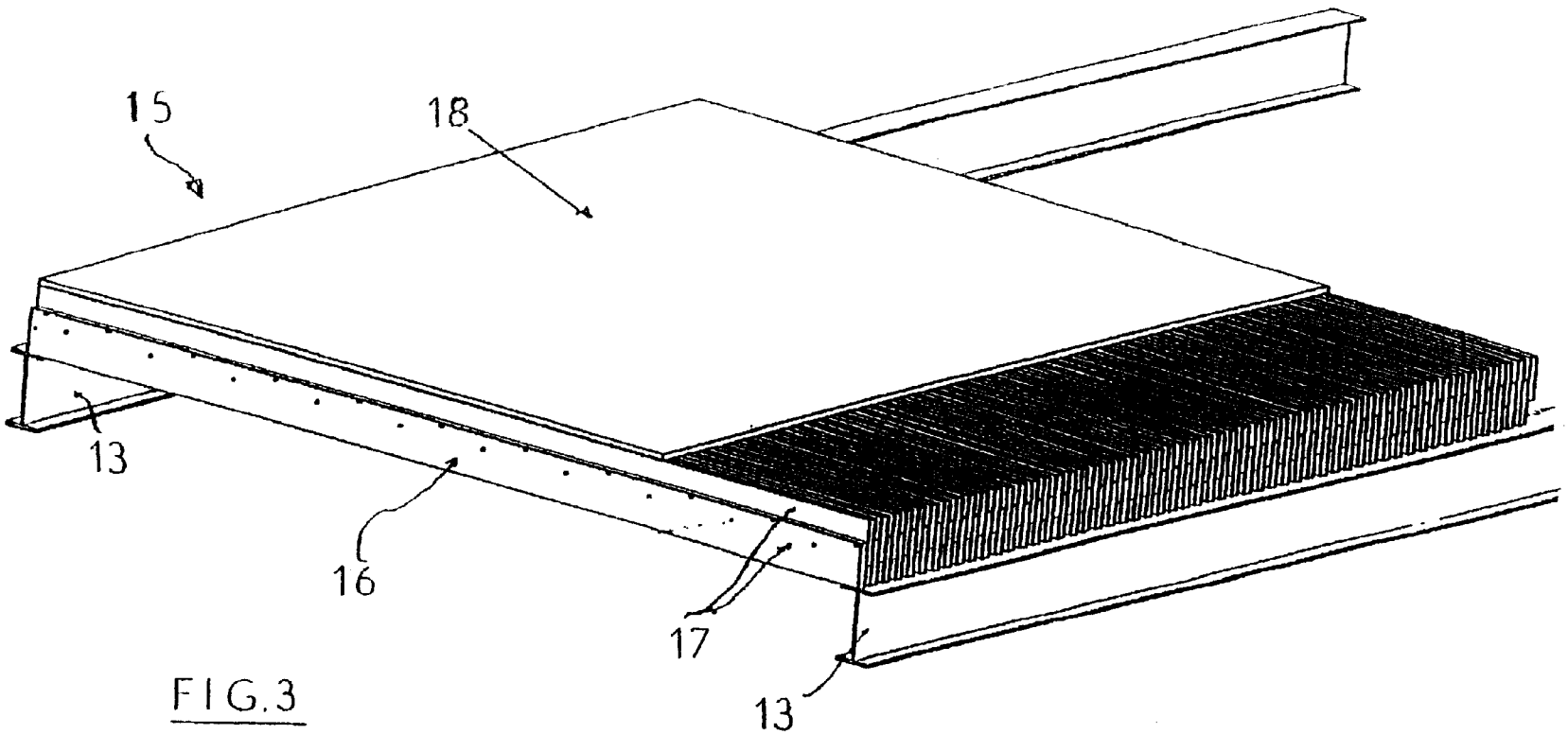
FIG. 3 is a rough perspective view of a slab produced according to the invention, set on two support beams (steel or wooden).

The characteristic slab (15) of the invention in FIG. 2 is visible in detail in FIG. 3.

Thus, according to the invention, this slab (15) consists, on the one hand, of a structure (16) consisting of a collection of various wooden planks (17) and, on the other hand, of a load-spreading panel (18) secured to the plank structure (16) by screws or nails making it possible, if necessary, to achieve a compound inertia, it also being possible for this principle to be applied to the underside.

According to an important feature of the invention, the slab (15) therefore comprises a structure (16) consisting of an assembly of planks (17) of standard dimensions.

Figure 4:
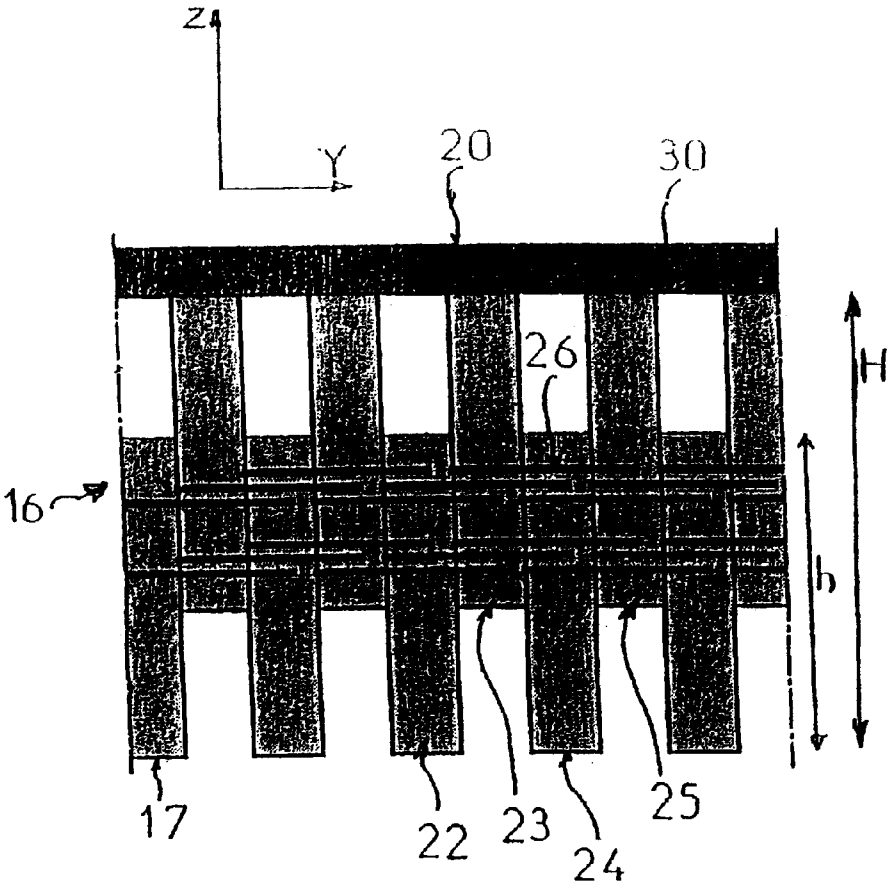
FIG. 4 is a part section view of a slab produced according to the invention, having a wooden or concrete load-spreading panel.

This assembly is illustrated in section in FIG. 4.

Thus, the various planks (17) that make up this assembly (16) are arranged with their longitudinal axis parallel to the plane (20) of the slab (15).

The planks (17) are joined together on their width (h). According to an important characteristic, the planks (22, 23) are offset alternately from one another and in a direction (Z) perpendicular to the plane (20) of the slab (15).

In other words, the plank structure has a height (H) greater than the width (h) of a single plank (17), this giving this structure the behaviour equivalent to that of a beam very much thicker than a standard plank, this thickness being obtained by offsetting the planks.

In practice, the various planks (22, 23) are offset from one another by a distance of between one half and two-thirds of their width (h).

The complete structure therefore has a thickness (H) of between 1.5 and 1.7 times the width (h) of a plank (17).

As the bending strength of a beam is proportional to the cube of its thickness, the composite beam of thickness (H) consisting of the structure (16) has bending strength properties which are two times greater than those that a beam of the same width, but of a thickness (h) equal to that of a unit plank (17) would have.

The various planks (22, 23) are joined together by screwing or nailing, as for example illustrated in FIG. 4. In this case, each plank (22) is screwed or nailed to the two adjacent planks (23, 24).

Of course, the density of joining means (26) can be optimized, depending on the desired bending capability and in order to spread the point load (for example a truck wheel) across several lateral planks.

The slab (15) illustrated in FIG. 4 has, above the structure (16) of characteristic planks, a load-spreading panel (30) which may be made of wood, in which case it will preferably be based on a panel of the "microply" type having a strong axis in the direction of the fibres and a weak axis in the direction of two or three crossed plies, this panel being screwed with its strong axis perpendicular to the axis of the planks.

This panel (30) makes it possible to spread the loads exerted along an axis perpendicular to the planks (17) and therefore parallel to the direction in which the planks are screwed or nailed together across several adjacent planks (23, 25).

Figure 6:
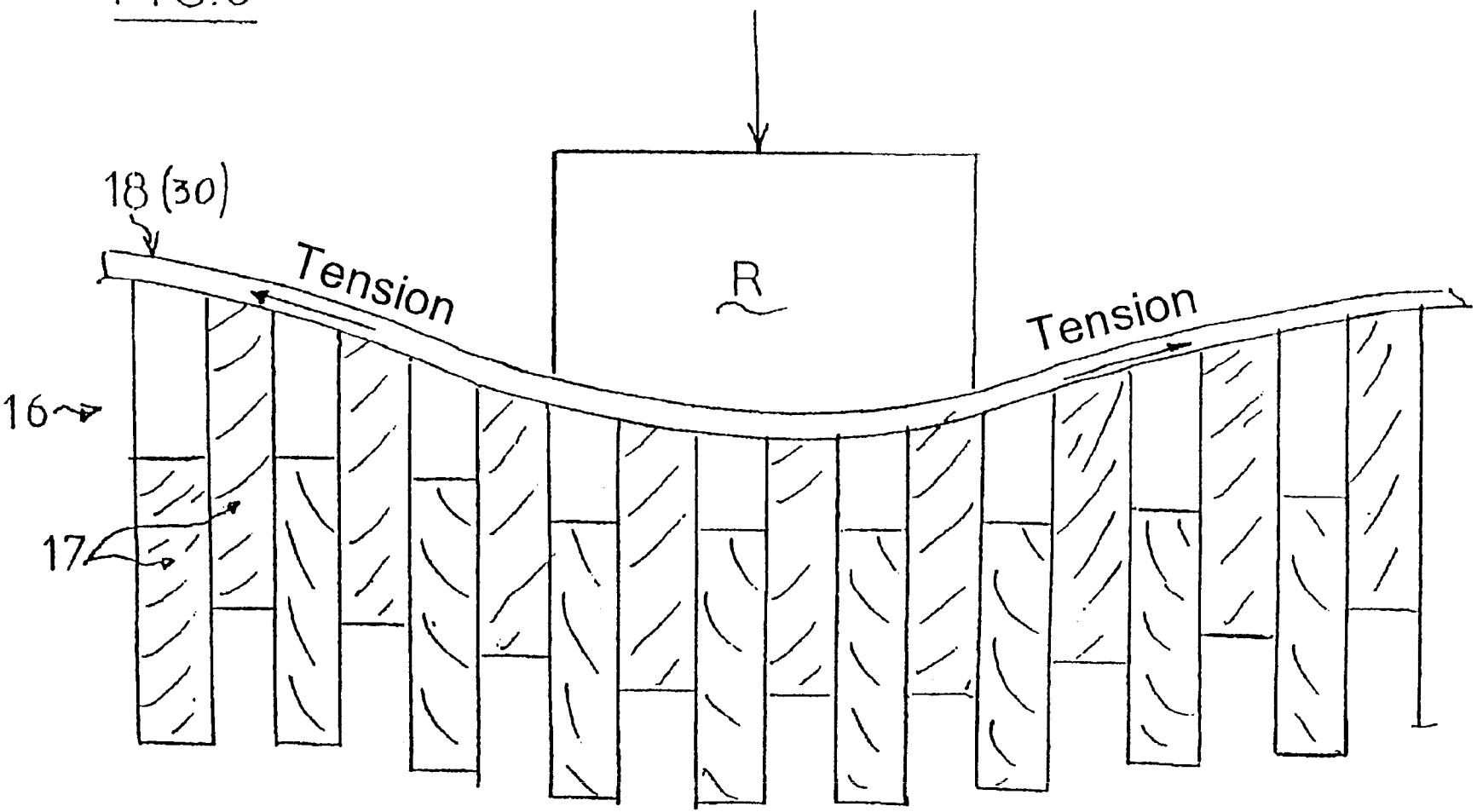
FIG. 6 schematically illustrates the way in which forces are transferred laterally by virtue of the presence of the load-spreading panel of a slab produced according to the invention.

As emerges from FIG. 6, a panel such as this makes it possible to obtain a slab effect, which is load-bearing in both directions of the plane.

Such a method of construction using a panel consisting of a crossed microply makes it possible, as emerges from FIG. 6, for the point load to be distributed across the width of the planks.

The said planks do not work only in beam mode, but the panel, reducing the anisotropy of the construction, therefore makes it possible to have strength in both directions.

For example, a truck wheel (R) transmits load over an area of 40×40 $cm^2$.

If a structure of the beam type were produced, only the planks constituting 40 cm would be working.

In consequence, by repeatedly running the load across this surface, the planks involved in the 40 cm would soon become rutted.

According to the invention, as emerges from FIG. 6, by calculating the thickness of the panel and its length, which may range as far as 12 meters, or even further, it is possible to optimize the behaviour of the slab.

Thus, with a load-spreading panel the thickness of which is equal to about 15% of the width of the planks, the load of the truck can be spread over 1.50 m. In consequence, 4 times as many planks contribute to the strength as compared with an unreinforced beam mode. In consequence, the shear forces of the truck wheel are absorbed by the panel rather than by the screws or nails that join the elemental planks together, thus eliminating any risk of rutting.

With the same reinforcement using the crossed microply panel, it has been found that by using a base structure with offset planks, better load-spreading is obtained compared with a system in which the elemental planks are at the same level.

This can be explained by the way the panel is put in tension under the point load by deformation of one plank in two, namely those in the upper part.

By contrast, in a system with all the planks at the same level, the panel would only be compressed and would not be put into tension until all the planks had deformed.

In the structure according to the invention comprising offset planks and a load-spreading panel, it is possible for the screws that join the planks together to be deliberately underengineered to allow the upper plank to sink further, thus increasing the tension in the panel and therefore the distribution of the load.

Such underengineering must not, however, be exaggerated because if it were, the composite section would lose its effectiveness and the upper and lower planks might slip with respect to each other as a result of the longitudinal shear forces.

By way of indication, when screws are used to join the elemental planks together, the optimum situation is to have a level of screwing equal to about 50% of the standard norm.

As far as shear is concerned, as screws allow a tensile force on all their axes, the reduction in the number of screws is compensated for by the friction of the planks at their contiguous surface. The screws provide a kind of preload perpendicular to the planks which improves the slab effect in the direction perpendicular to the said planks.

With the presence of these screws and this preload introduced thereby, the behaviour in shear is therefore optimum and the efficiency of the composite section is close to 100%.

By way of example, in an embodiment such as illustrated in FIG. 6, it is possible to obtain a structure which has very good characteristics using 20 screws per $m^2$ of a diameter of 6 mm and a length of 220 mm, whereas standard practice would generally dictate the use of 40 screws.

In practice, good abilities to withstand loadings, particularly a load of 350 kilo/m$^2$, to which is added the weight applied by a vehicle wheel corresponding to 7500 kilos has been obtained by using elemental planks of rectangular cross section measuring 175×38 mm, joined together by screws or nails 4 mm in diameter and 100 mm long, the entire assembly being covered with a panel of the 9-ply "microply" type, the 3rd and 7th plies being crossed with respect to the other plies, the said panel being 27 mm thick, therefore namely 15% of 175 mm.

Figure 5:
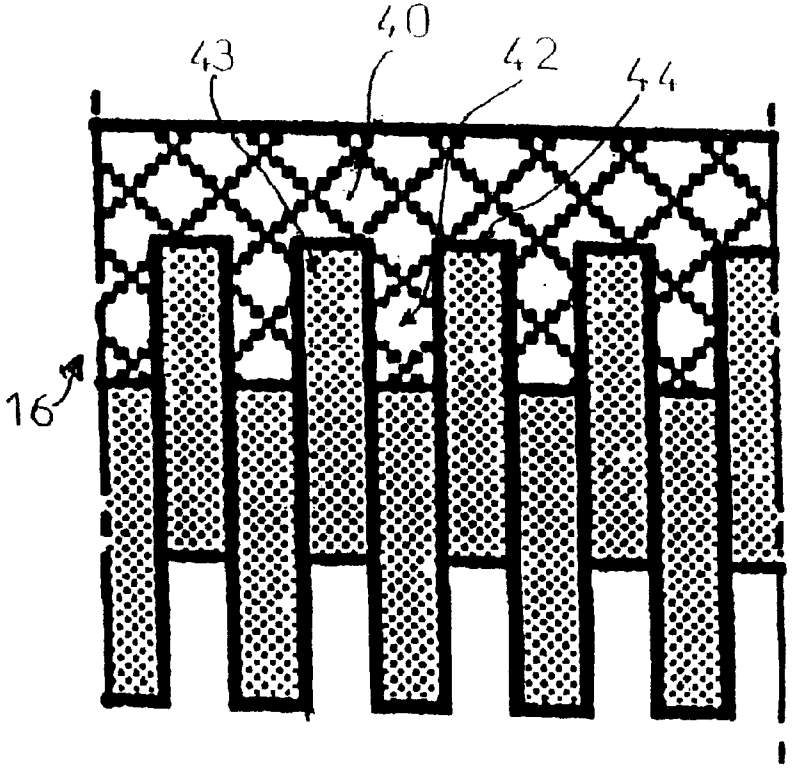
FIG. 5 is a part section view of a slab produced according to the invention, in which the load-spreading panel is made of a layer of concrete poured onto the structure.

In another form of embodiment, as illustrated in FIG. 5, the load-spreading panel (4) situated on the top of the structure (16) of a wooden plank may consist of a layer of reinforcing concrete which may advantageously, but not necessarily, as illustrated in FIG. 5, be poured directly onto the wooden planks structure (16).

In this case, the concrete infiltrates into the spaces (42) there are between the offset planks (43, 44) which improves the properties of the slab in the transverse direction, the concrete better spreading the point load.

Figure 11:
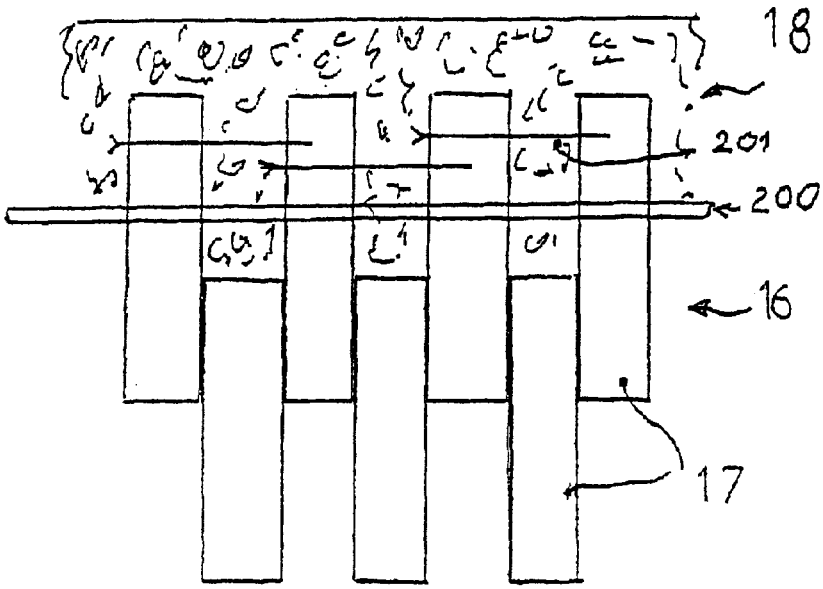
FIG. 11 illustrates an alternative form of a slab the load-spreading plate of which consists of a layer of concrete comprising steel reinforcement.

A composite section system with the concrete in compression and the wood in tension can be obtained by inserting connectors (200), (201) that connect the two materials (screws, anchor bolts or the like), as shown schematically in FIG. 11.

In practice, in order to withstand the same loads as in the previous example, in which the load-spreading panel consisted of a microply structure, use will advantageously be made of a concrete with a fine particle size and a conventional density of the order of 2.4.

As already stated, the slabs according to the invention may constitute a platform in itself, or may be joined together to form very large-sized platforms.

This second solution will be preferred if there is a desire for the various elements to be transported from a manufacturing site to an installation site, so as to be able to use ordinary transport means.

Thus, in practice, it proves advantageous to use unit slabs 2 meters wide and up to 40 m long, the length being limited by transport considerations. In order to obtain this dimension, the planks are nailed or screwed end to end, preferably placing the joints in areas where the bending moment is low.

Thus plank lengths of 4 or 5 m make it possible to produce a slab over several static supports 6 m apart and for lower loads, up to a scale of about 12 meters.

Figure 7:
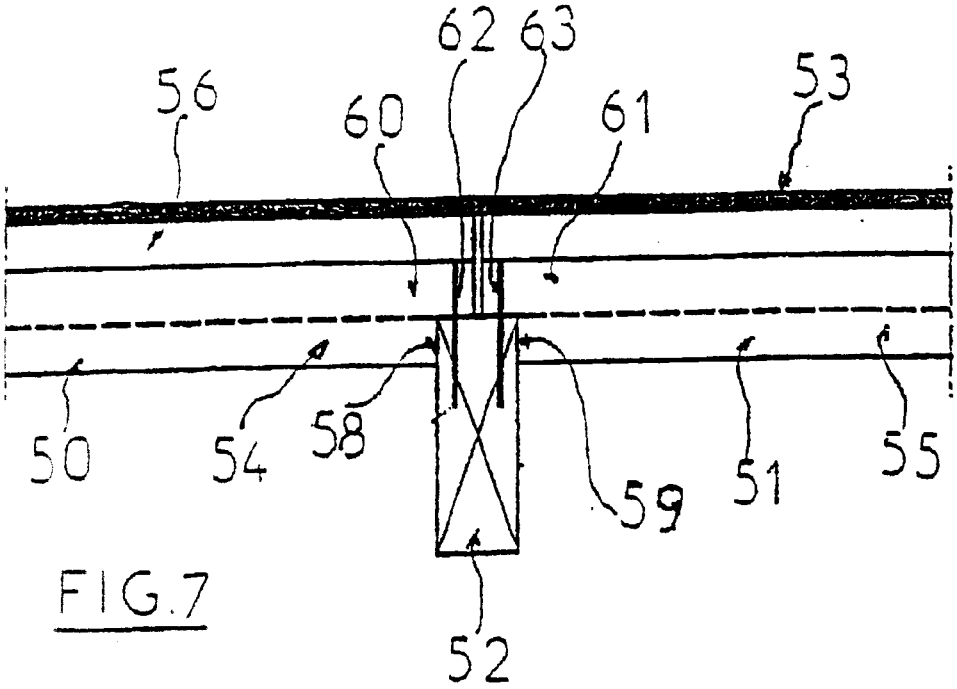
FIG. 7 is a view in section of the region where two slabs according to the invention are joined, to make it possible to produce a large-sized platform.
Figure 8:
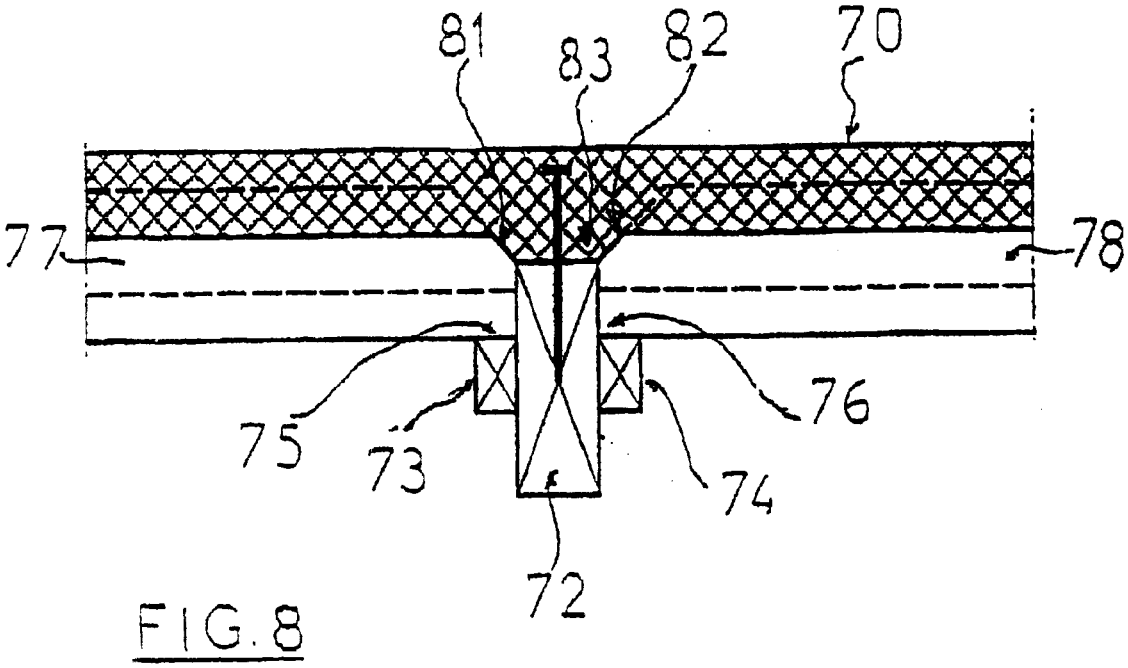
FIG. 8 is an alternative form of embodiment of the region of the joint, when the load-spreading plate is made, for example, of concrete.

The various slabs intended to be combined to form the definitive platform are mounted on the bearing structure, as illustrated in FIGS. 7 and 8.

Thus, as can be seen in FIG. 7, two assembled planks structures (50, 51) are combined at a beam (52) of the bearing structure.

For this purpose, the planks (54, 55) of the two bearing structures (50, 51) of each of the panels (56, 57) have cut-outs at their lower edge (58, 59) so that the planks (60, 61) constituting the upper part of each of the assembled planks structures rest on the beam (52).

Metal connectors of the screw or anchor bolt type (62, 63) are used to secure the two planks structures (50, 51) to the beam.

In the scenario illustrated in FIG. 7, there is a single load-spreading plate (53) shared by the two adjacent planks structures (50, 51), but this could be replaced by two independent panels.

In the scenario in which a pressure-spreading element consists of a layer of concrete (70), and as illustrated in FIG. 8, bearing joists (73, 74) against which the lateral ends (75, 76) of the assembled planks structures (77, 78) rest may be provided at the beam (72) of the bearing structure. The forces are then transmitted to the main beam, the inertia of which can be increased by connecting the concrete material to this beam.

In the case illustrated in FIG. 8, the upper part (81, 82) of the planks structures (77, 78) is cut out so that the layer of concrete (70) poured directly over the planks structures (75, 76, 77, 78) forms a cone (83) bearing via its base on the top of the beam (72) of the bearing structure.

There is advantageously provided a connector (85), the end of which is fixed inside the beam (72) of the bearing structure, and the upper part of which finds itself embedded in the layer of concrete (70). The layer of concrete is thereby firmly anchored so as to achieve a compound wood and concrete action on the main beam (72).

Figure 9:
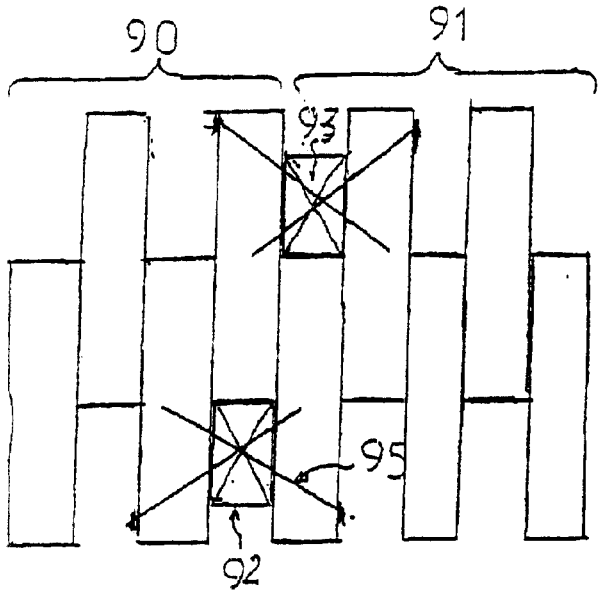
FIG. 9 is a part section view of one way of producing the joint between two slabs according to the invention.

FIG. 9 illustrates a particular embodiment of the combination of two assembled planks structures (90, 91). In this case, additional blocks (92, 93), held in place by screwing and/or nailing (95) and the essential objective of which is to compensate for the offset of the planks and thus avoid bending the unit plank may be provided in the region where these two structures (90, 91) come into contact. This forms a kind of seam.

Figure 10:
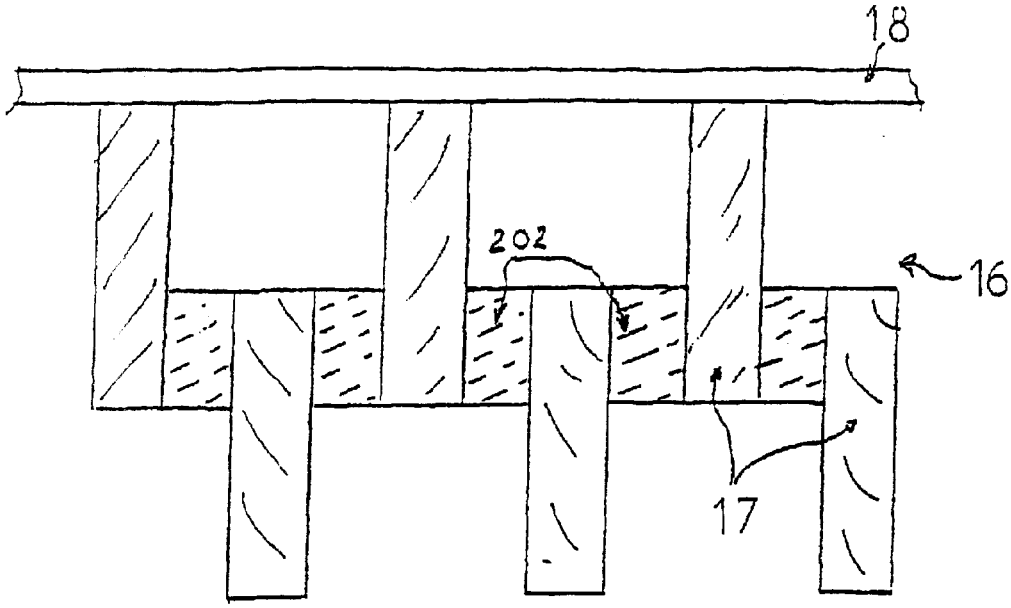
FIG. 10 schematically illustrates an alternative form of a slab according to the invention, comprising spacer pieces between two consecutive planks.

FIG. 10 for its part illustrates an alternative form of a slab according to the invention in which additional spacer pieces (202) are arranged between two offset elemental planks of the base structure.

Such spacer pieces may possibly be made of particle board and make it possible to save on planks.

In such a case, the load-spreading panel is sized to take account of these additional plank spacings.

Figure 12:
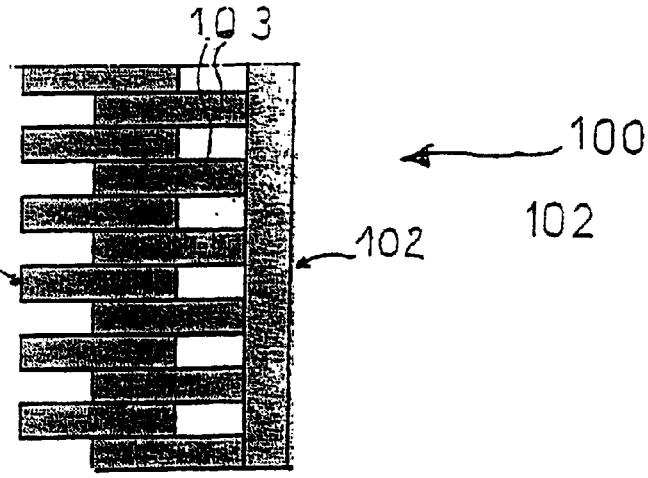
FIGS. 12 and 13 are part section views of slabs according to the invention, used to form vertical walls of buildings.
Figure 13:
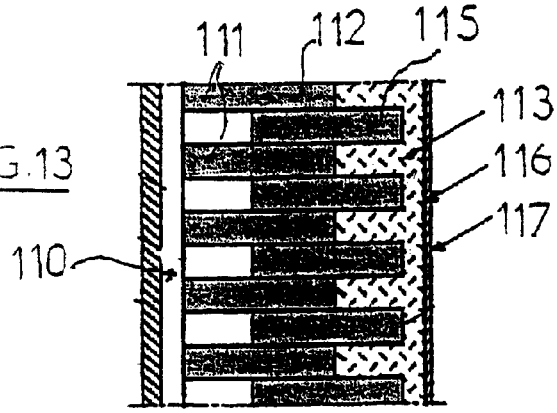

As already stated, the building slab according to the invention can be used not only for producing horizontal platforms and slabs, but also for producing walls or partition walls of buildings, as illustrated in FIGS. 12 and 13.

Thus, as illustrated in FIG. 12, the wall (100) consists of slabs according to the invention, the assembled planks structure (101) of which is situated on the interior side of the wall, so as to be visible, while the outer part of the wall consists of a rigid plate (102) intended to spread the loads over a number of planks (103) of the structure (101). This then makes it possible for forces exerted by the wind, which, as is known, can be particularly high, to be spread. This plate will also act as a support layer for the finish (rendering, paint, etc.).

In the alternative form illustrated in FIG. 13, the slab according to the invention has, facing outwards, a load-spreading plate (110) which comes into contact with half of the planks (111) of the assembled planks structure (112). This panel may advantageously be spaced off so as to allow natural ventilation of the planks should water infiltrate.

On the inner side of the wall, there is a layer of insulation (113) which is fitted to that face (115) of the assembled planks structure (112) which faces into the wall.

This layer of insulation (113) is covered with a finish layer (116) and possibly a barrier layer (117) preventing vapour from passing towards the insulant.

It is apparent from the foregoing that the building slab structure according to the invention has numerous advantages, particularly:

- good bending strength with a saving of material by virtue of the use of the offset between the planks of which it is made;

in the embodiment whereby the load-spreading panel is made of a microply structure screwed to the base structure, it is possible for the assembled planks structure to be fully dismantled when the platform or the building needs to be taken down, thus allowing the planks of which it is made to be re-used or recycled for another branch of industry (shuttering, packaging, or plank beams, etc.).

What is claimed is:

1. A building slab mountable on a bearing structure and capable of withstanding a load, said slab comprising:

a base structure comprising a plurality of parallel planks of rectangular cross section joined together with at least one of nails and screws, said planks of rectangular cross section having their longitudinal axis parallel to a plane of said slab, and being offset alternately from one another perpendicularly to said plane of said slab, said planks being offset alternately by a distance of between half and two-thirds of their width; and said base structure being covered, over at least an entire surface to receive the load, with a continuous panel extending across an entire width of said base structure, fixed at least against an upper surface of said planks of said base structure, and which allows the load exerted on said panel to be spread across several planks adjacent to those against which the load is directly exerted so that the load is spread along an axis perpendicular to said planks and parallel to a direction in which said planks are at least one of nailed and screwed together.

2. The slab of claim 1 further comprising a panel disposed against a lower surface of said planks.

3. The slab of claim 1 wherein said panel comprises a wooden panel of crossed microply type, comprising a strong axis in a direction of the fibers and a weak axis in a direction of at least one cross ply, said panel being attached with screws to said base structure with said strong axis perpendicular to said axis of said planks of said base structure.

4. The slab of claim 1 wherein said panel comprises at least one of a layer and a sheet of concrete.

5. The slab of claim 4 wherein said least one of said layer and said sheet is poured into a plurality of said planks of said base structure.

6. The slab of claim 4 further comprising a plurality of metal rods incorporated into said at least one of said layer and said sheet of concrete.

7. The slab of claim 1 further comprising at least one of a thermal and an acoustic insulant disposed in a space between said panel and said offset planks of said base structure.

8. A collection of slabs comprising a plurality of slabs of claim 1 erected on a bearing structure formed of a plurality of beams, and wherein each slab has a cut-out capable to allow said slab to be arranged with said beams.

9. A method for producing a platform capable of withstanding a moving load and operable as a roadway for civil engineering work vehicles and delivery vehicles used in erecting buildings, the method comprising:

providing a bearing structure;

providing a slab of claim 1; and mounting the slab on the bearing structure to produce the platform.

10. A method for producing a vertical wall for a building, the method comprising:

providing a slab of claim 1; and positioning a plane of the slab in a vertically disposed orientation.

* * * * *